US007033241B2

(12) United States Patent
Lee et al.

(10) Patent No.: US 7,033,241 B2
(45) Date of Patent: Apr. 25, 2006

(54) TOY VEHICLE

(75) Inventors: Jason C. Lee, Talent, OR (US); Justin Discoe, Merchantville, NJ (US); Nathan Bloch, Cherry Hill, NJ (US)

(73) Assignee: Mattel, Inc., El Segundo, CA (US)

( * ) Notice: Subject to any disclaimer, the term of this patent is extended or adjusted under 35 U.S.C. 154(b) by 373 days.

(21) Appl. No.: 10/699,385

(22) Filed: Oct. 30, 2003

(65) Prior Publication Data

US 2004/0198165 A1 Oct. 7, 2004

Related U.S. Application Data

(60) Provisional application No. 60/422,595, filed on Oct. 31, 2002.

(51) Int. Cl.
*A63H 17/14* (2006.01)

(52) U.S. Cl. ..... 446/427; 446/456; 446/470

(58) Field of Classification Search ..... 446/427, 446/454, 456, 470, 278
See application file for complete search history.

(56) References Cited

U.S. PATENT DOCUMENTS

| | | | | |
|---|---|---|---|---|
| 4,543,073 | A | 9/1985 | Matsuda | |
| 4,597,744 | A * | 7/1986 | Rehkemper et al. | 446/278 |
| 4,626,223 | A * | 12/1986 | Sweet | 446/279 |
| 4,666,420 | A | 5/1987 | Nagano | |
| 4,671,779 | A | 6/1987 | Kurosawa | |
| 4,674,585 | A | 6/1987 | Barlow et al. | |
| 4,705,487 | A | 11/1987 | Ishimoto | |
| 4,813,906 | A | 3/1989 | Matsuyama et al. | |
| 4,932,491 | A | 6/1990 | Collins, Jr. | |
| 5,129,854 | A | 7/1992 | Hill | |
| 5,362,272 | A * | 11/1994 | Chow et al. | 446/278 |
| 5,487,692 | A | 1/1996 | Mowrer et al. | |
| 5,586,924 | A | 12/1996 | Huang | |
| 5,609,510 | A | 3/1997 | Stubenfoll et al. | |
| 5,643,041 | A | 7/1997 | Mukaida | |
| 5,667,420 | A | 9/1997 | Menow | |
| 5,667,421 | A * | 9/1997 | Uetake | 446/470 |
| 5,676,585 | A | 10/1997 | Nuermberger, III | |
| 5,727,985 | A | 3/1998 | George et al. | |
| 5,752,871 | A | 5/1998 | Tsuzuki | |
| 5,803,790 | A | 9/1998 | Tilbor et al. | |
| 5,860,846 | A * | 1/1999 | Uetake | 446/470 |
| 5,871,386 | A | 2/1999 | Bart et al. | |
| 5,919,075 | A | 7/1999 | George et al. | |

(Continued)

*Primary Examiner*—Derris H. Banks
*Assistant Examiner*—Ali Abdelwahed
(74) *Attorney, Agent, or Firm*—Akin Gump Strauss Hauer & Feld, LLP

(57) ABSTRACT

A toy vehicle has a chassis, at least a first drive wheel rotatably attached to the chassis and at least a first link having a first end pivotally coupled with the chassis. At least a first non-powered wheel is operably coupled with the second opposing end of the first link. The first link has two operative positions: a first, fully-retracted operating configuration in which the first link is wrapped at least partially around the chassis crossing the drive wheel axis of rotation and a second, extended operating configuration in which the first link is pivoted away and extended from the chassis. A second link can be pivotally coupled between and with the chassis and first link. Forces acting on the toy vehicle resulting from driving the first drive wheel can cause each link to pivot with respect to the chassis.

20 Claims, 7 Drawing Sheets

U.S. PATENT DOCUMENTS 5,951,363 A * 9/1999 Uetake ..... 446/470
6,024,627 A 2/2000 Tilbor et al.
6,066,026 A 5/2000 Bart et al.
6,095,890 A 8/2000 George et al.
6,132,287 A 10/2000 Kuralt et al.
6,227,934 B1 5/2001 Isaksson et al.
6,234,866 B1 5/2001 Ben-Yakar et al.
6,394,876 B1 * 5/2002 Ishimoto ..... 446/428
6,540,583 B1 * 4/2003 Hoeting et al. ..... 446/431
2001/0027078 A1 10/2001 Lee

* cited by examiner

TOY VEHICLE

CROSS-REFERENCE TO RELATED APPLICATIONS

This application claims benefit of U.S. Provisional Patent Application 60/422,595, "Toy Vehicle", filed Oct. 31, 2002.

BACKGROUND OF THE INVENTION

The present invention relates generally to toy wheeled vehicles, and more particularly to a toy vehicle comprising multiple pivoting linkages which may be alternatively collapsed around or extended from a portion of the vehicle, the total length of the vehicle being thereby variable.

Toy wheeled vehicles are well-known. One class of known toy vehicles includes chassis or chassis/body combinations that are or have linkages permitting parts of the chassis or chassis/body combination to flex and allow the vehicle to change its configuration. The prior art, for example U.S. Pat. Nos. 4,597,744; 4,626,223 and 4,813,906, discloses vehicles comprised of multiple links capable of pivoting with respect to one another. U.S. Pat. No. 4,671,779 discloses a motorized running toy wherein multiple linkages forming a flexible tail-like structure may be collapsed about a drum-like main portion of the toy having a central axis or extended axially from the drum-like portion of the toy having the central axis.

A toy vehicle which provides multiple operative configurations not previously provided combined with highly dynamic performance should provide more engaging play activity than does a toy vehicle which has a fixed operative configuration or more slowly paced performance.

BRIEF SUMMARY OF THE INVENTION

Briefly stated, the invention is a toy vehicle comprising a chassis, an electric power supply supported by the chassis and at least a first drive motor also supported by the chassis and receiving power from the electric power supply. At least a first drive wheel is mounted to the chassis to rotate about a wheel axis, the first drive wheel being operably coupled with at least the first drive motor. At least a first link is provided having a first end, pivotally coupled with the chassis, and a second opposing end. The first link has two operative positions: a first, fully-retracted operating configuration wherein the first link is positioned against the chassis, at least transversely spanning the wheel axis; and a second, extended operating configuration wherein the first link is pivoted away and extended from the chassis and the wheel axis. At least a first non-powered wheel is rotatably attached to the second opposing end of the first link, the toy vehicle being supported on the at least one driven wheel and the at least one non-driven wheel in both the first and second operating configurations of the at least first link.

In another aspect, the invention is a toy vehicle comprising a chassis, an electric power supply supported by the chassis and at least a first drive motor also supported by the chassis and receiving power from the electric power supply. At least a first drive wheel is rotatably mounted to the chassis, the first drive wheel being operably coupled with at least the first drive motor. A plurality of pivotally connected links form a link chain having a first end pivotally connected to the chassis and having at least one non-powered wheel at a second end most distal from the chassis. The link chain has a first operating position wrapped at least substantially around the chassis and a second operating position unwrapped and extended away from the chassis. The toy vehicle is supported on the at least one driven wheel and the at least one non-driven wheel in both the first and second operating positions.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
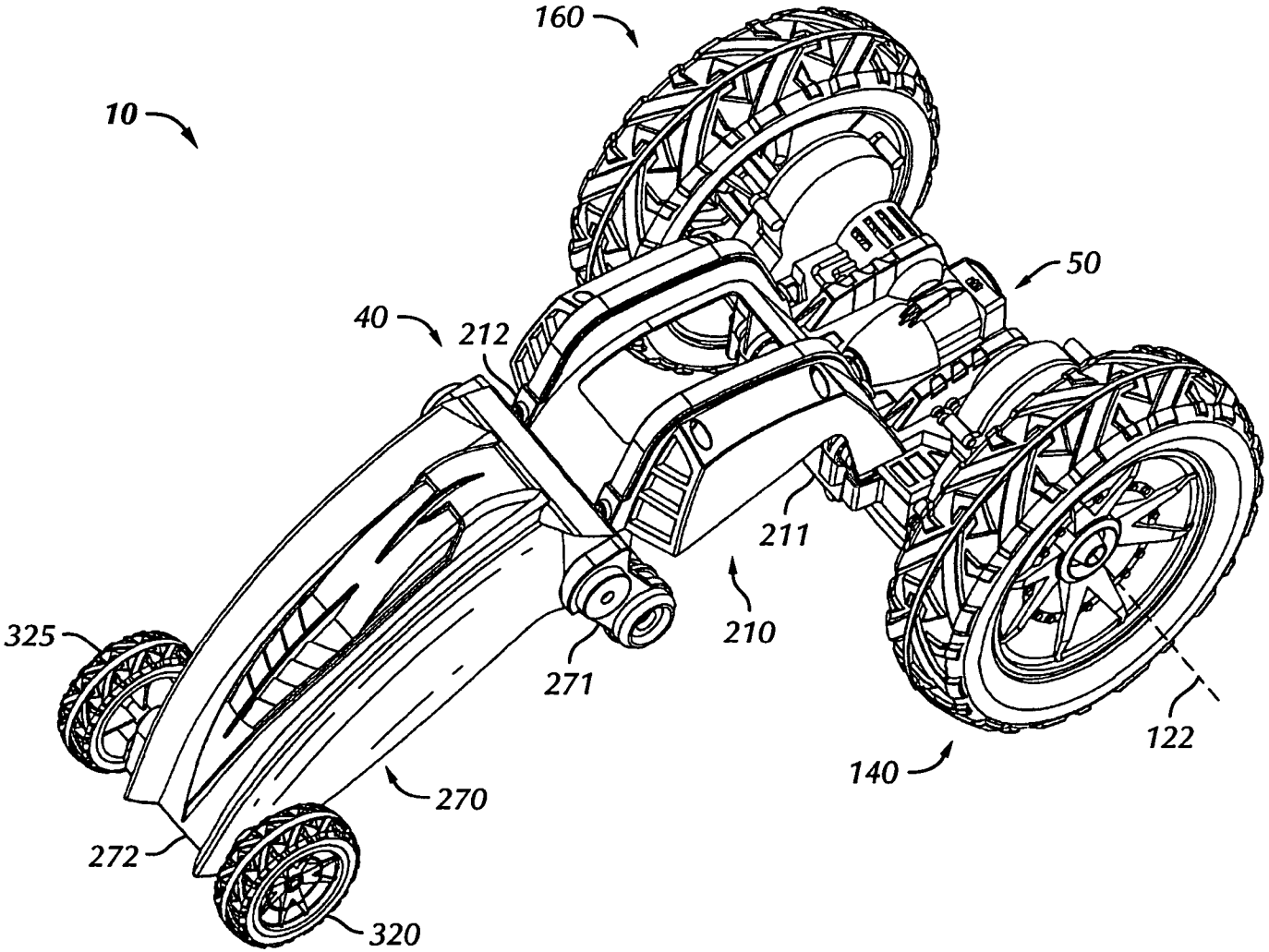
FIG. 1 is a top perspective view of one embodiment of the present invention showing a toy vehicle in a fully extended configuration.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the toy vehicle and designated parts thereof. The terminology includes the words above specifically mentioned, derivatives thereof and words of similar import.

As used herein, the phrase indicating that a link is "wrapped around the chassis" refers to a link, pivotally connected to a chassis, wherein the link is rotated into a position such that the link is generally adjacent to the chassis. For the first link described below, the extent of the "wrap" is characterized by an arc contained in a plane perpendicular to a drive wheel axis of rotation, the arc being centered at the drive wheel axis of rotation, and the arc extending between first and second radial lines extending from the drive wheel axis, the first radial line extends to a first end of the first link where the first link pivotally connects to a remainder of the toy vehicle and the second radial line extends from the drive wheel axis to an axis of rotation of a wheel mounted on a second end of the first link. For the second link described below, the extent of the wrap is characterized by an arc contained in a plane perpendicular to the drive wheel axis of rotation, the arc being centered at the drive wheel axis of rotation, and extending between first and second radial lines extending from the drive wheel axis, the first radial line extending to a first end of the second link where the second link pivotally connects to the chassis and the second radial line extending from the drive wheel axis to a second end of the second link where the second link pivotally connects to the first link.

Referring to the figures, wherein like numerals are used to indicate like elements throughout, there is shown in FIGS. 1–10, preferred embodiments of a toy vehicle, generally designated 10, in accordance with the present invention.

Referring now to FIG. 1, a first preferred embodiment of the toy vehicle 10 is shown in a fully extended configuration 40. The toy vehicle 10 comprises a chassis assembly or simply "chassis" 50. The term "chassis" is intended to denote the main structural element of the toy vehicle 10, whether it is provided by a frame and separate attached body or a monocoque or unibody structure in which decorative body elements and load bearing elements are intermixed or a hybrid of the two. At least a first, and preferably first and second drive wheels 140, 160 are rotatably mounted to the chassis 50 on opposing lateral sides of the chassis 50 to rotate about wheel axes, which are their common central axis 122. In this first preferred embodiment, the toy vehicle 10 comprises a first link 270 and a second link 210. The second link 210 is pivotally attached at a first end 211 to the chassis 50. A second opposing end 212 of the second link 210 is further pivotally attached to a first end 271 of the first link 270. At least a first, and preferably first and second non-driven or non-powered wheels 320, 325 are rotatably attached to a second opposing end 272 of the first link 270. Thus, the first end 271 of the first link 270 is pivotally coupled with the chassis 50 through the second link 210.

Figure 2:
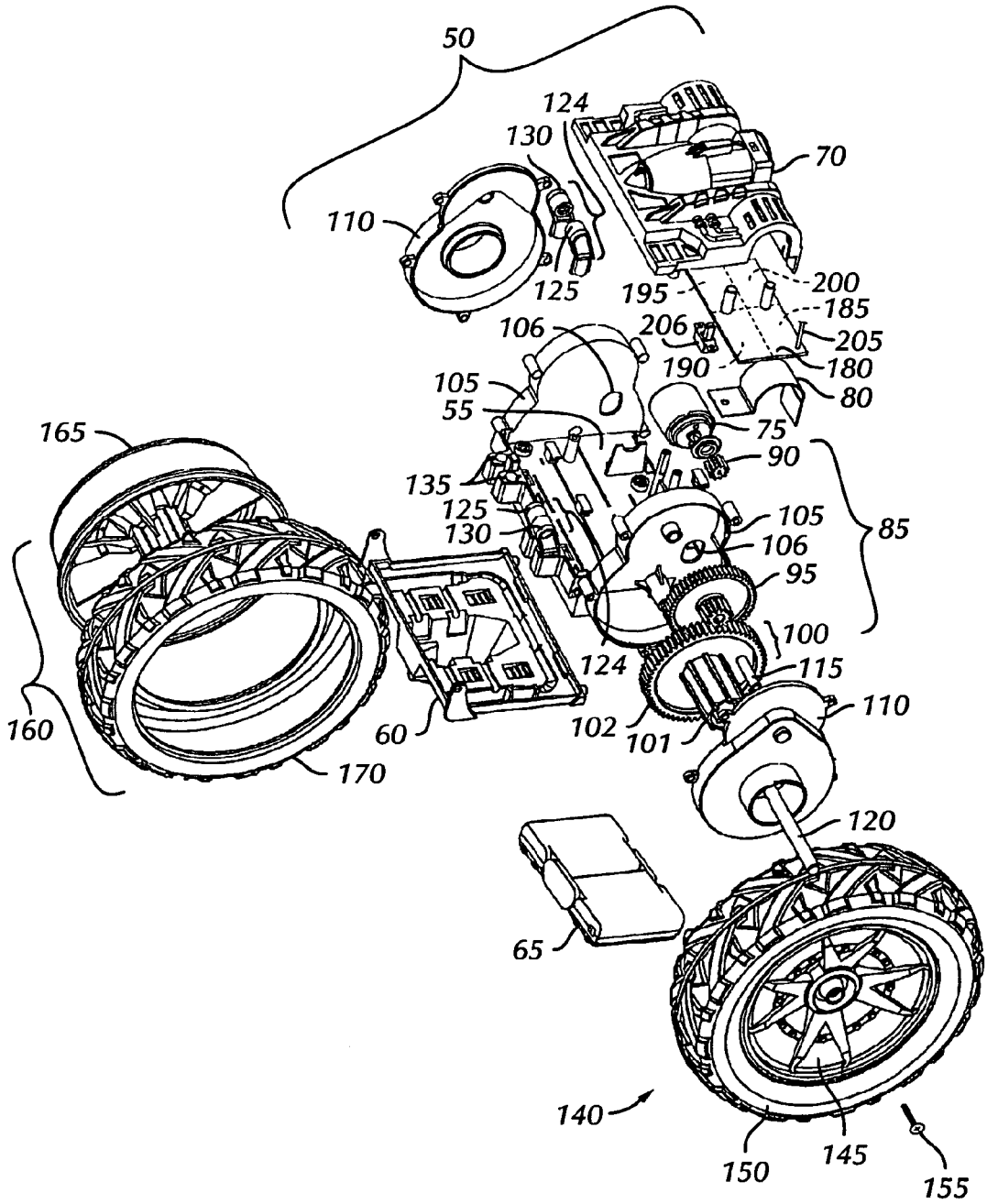
FIG. 2 is a exploded assembly view of a first "chassis" portion of the toy vehicle of FIG. 1.

FIG. 2 depicts the chassis 50 in exploded form with electric power supply 65 and drive wheel 140, 160, which are assemblies and the latter of which being exploded. The chassis 50 preferably is an assembly that comprises a base plate 55. A decorative body 70 attaches to the top of the base plate 55. Together, the base plate 55 and body 70 define a generally rectangular lateral profile for the chassis 50 in a plane perpendicular to the wheel axis 122. A electric power source door 60 is hingedly attached to the bottom of the base plate 55. Enclosed within the space between the base plate 55 and the electric power source door 60 so as to be supported by the chassis is an electric power supply 65. The electric power supply 65 may be a flexible battery pack like that disclosed in U.S. Pat. No. 5,853,915, incorporated by reference. Alternatively the artisan will recognize that the electric power supply could be a conventional rechargeable battery pack, individual dry cell batteries, solar cells, capacitive power supplies or other sources of electrical power.

The electric power supply 65 supplies power to a first drive motor 75, which is affixed to the base plate 55 and operably coupled, more particularly, drivingly coupled with first drive wheel 140. The drive motor 75 is affixed to the base plate 55 by suitable means such as a metallic strip 80, formed to match the cylindrical shape of the drive motor 75. The strip 80 is preferably made from aluminum, and serves not only to secure the drive motor 75 in place, but also serves as a heat sink to dissipate heat generated by the drive motor 75. The drive motor 75 has a pinion 90 attached to an output shaft of the drive motor 75. The pinion 90 protrudes though an opening 106 in an interior gear housing 105 to drivingly engage a combination gear 95. The combination gear 95 in turn is drivingly engaged with a combined gear and splined shaft 100 that rotates on a first wheel axle 120 which can be stationary or free rotating. A splined shaft portion 101 of the combined gear and shaft 100 extends within and drivingly engages a hub 145 of the first drive wheel 140. Axle 120 supports combined gear and splined shaft 100. Shaft 115 supports combination gear 95. Together, the pinion 90, combination gear 95, and combined gear and splined shaft 100 form a drive gear assembly 85. The drive gear assembly 85 is enclosed by the interior gear housing 105 and an exterior gear housing 110. In particular, the gear portion 102 of combined gear and splined shaft 100 is enclosed and captured by the housings 105, 110 while the splined shaft 101 receives the drive wheel 140. The first drive wheel 140 is preferably an assembly that comprises the hub 145 and a hollow, air-filled ("pneumatic") tire 150. The hub 145 of the first drive wheel 140 is secured to the splined shaft 101 by suitable means such as a securing fastener in the form of a screw 155 received in the shaft. An identical motor 75, strip 80 and drive gear assembly 85 is symmetrically provided on the other lateral side of the vehicle to drive the second drive wheel 160. The second drive wheel 160 similarly is an assembly that comprises a hub 165 and a pneumatic tire 170 and is identically attached.

The chassis 50 further comprises two pivot arm attachments 124. The pivot arm attachments 124 are preferably assemblies formed by the combination of a pivot arm attachment male portion 125 and a pivot arm attachment female portion 130, which mate together to form each pivot arm attachment 124. The pivot arm attachment male and female portions 125, 130 are held in position by adjacent pivot arm attachment receptacles 135 preferably provided on the base plate 55.

The chassis 50 further supports electronic controls for the toy vehicle 10. A circuit board 180 is disposed between the base plate 55 and the cover plate 70. The circuit board 180 comprises a wireless control (e.g. radio) receiver 185 supported by the chassis 50 and configured to receive wireless control signals to selectively control at least first drive motor 75, a processor circuit 190, a first motor control circuit 195, and a second motor control circuit 200, all indicated diagrammatically, in phantom. An antenna 205 inside the chassis 50 is operatively coupled with the radio receiver 185. An on/off switch 206 is further provided.

Figure 3:
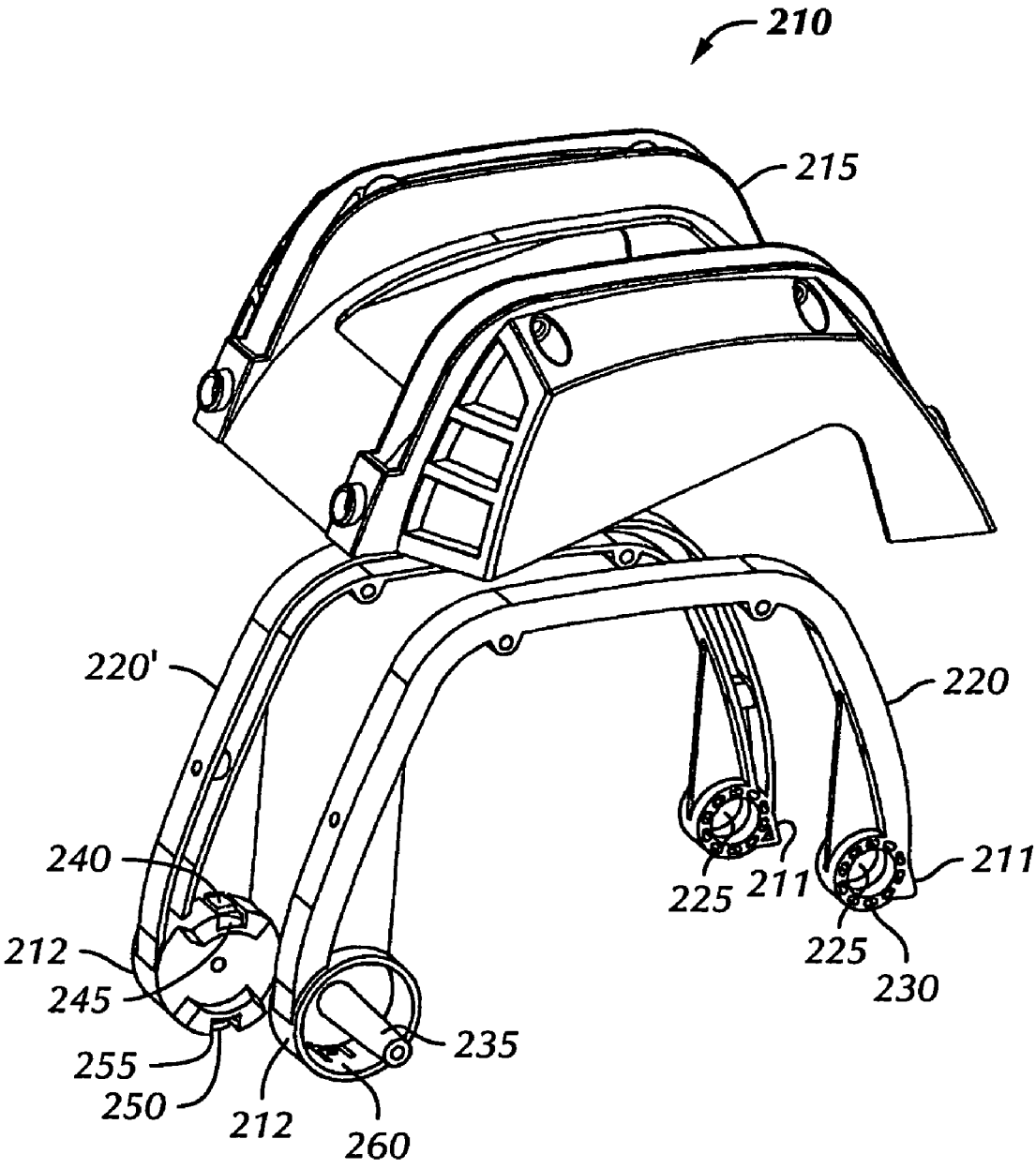
FIG. 3 is an exploded assembly view of a second link comprising the toy vehicle of FIG. 1.

With particular reference now to FIG. 3, the second link 210 is illustrated. The second link 210 is preferably an assembly comprised of mirror pivot arms 220, 220' and a cover plate 215 which attaches to and fixedly couples together the pivot arms 220, 220'. At the first end 211 of the link 210 and pivot arms 220, 220', an attachment hole 225 is provided in each arm. The pivot arm attachments 124 of the chassis 50 fits within these attachment holes 225 to pivotally secure the first end 211 of the link 210 and pivot arms 220, 220' to the chassis 50. Small hollowed out portions 230 are disposed about the circumference of the attachment holes 225 to reduce weight. At the second opposing end 212 of the link 210 and the pivot arms 220, 220', shafts 235 extend laterally outwardly from the pivot arms 220, 220'. These shafts 235 mate with corresponding shaft housings 295 included as part of the first link 270, described in detail below. At the second end 212, each pivot arm 220 is further provided with first and second locking slots 245, 255 and first and second locking tabs 240, 250. Each locking slot 245, 255 is provided with a protrusion 260.

The functions of the locking slots 245, 255, locking tabs 240, 250 and slot protrusions 260 is described below.

Figure 4:
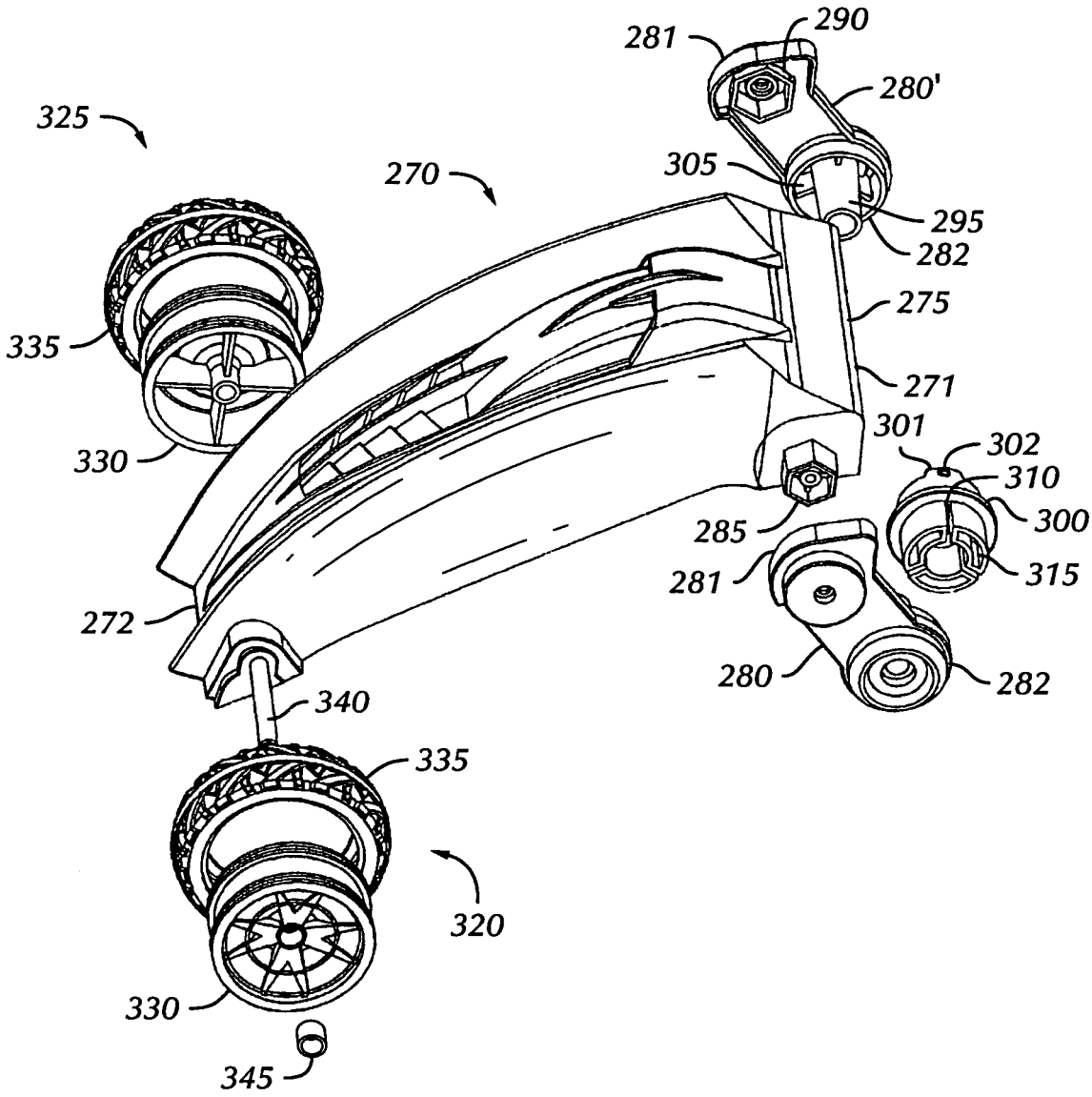
FIG. 4 is a exploded assembly view of a first link comprising the toy vehicle of FIG. 1.

With particular reference now to FIG. 4, the first link 270 is illustrated. The first link 270 preferably is an assembly that comprises the elements shown in the figure, including a body 275 and non-powered wheels 320, 325. At the first end 271 of the link 270 and body 275, mirror connection arms 280, 280' are fixedly attached to the body 275. The body 275 includes affixed, hexagonally-shaped protruding male elements 285. The connection arms 280, 280' are provided with corresponding hexagonally-shaped female elements 290 disposed on the interior side of a first end 281 of the connection arms 280, 280'. The connection arms 280, 280' are affixed to the body 275 preferably with screws or other fasteners such as rivets or stakes (none shown). The mating male and female elements 285, 290 thus prevent rotation of the connection arms 280, 280' with respect to the body 275. Other structures could be used to non-rotably mount the arms 280, 280' to the body 275.

At a second end 282 of each of the connection arms 280, 280' (and the body 275), the shaft housings 295 project inwardly and rotatably receive the shafts 235 on the pivot arms 220, 220'. Attached to the shaft housings 295 are spoke structures 305. Locking elements 300 are assembled between the connection arms 280, 280' and the second ends 212 of the pivot arms 220, 220', respectively. As in the one preferred embodiment illustrated, each locking element 300 comprises on one lateral side, three separate laterally projecting arcuate structural portions 315 which define three slots 310 between the structural portions 315. The spokes 305 fit within the slots 310. The locking elements 300 slide over the shaft housings 295, moving laterally in and out. The locking elements 300 are fixed rotationally with respect to the connection arms 280, 280' by interference of the structural portions 315 with the spokes 305. On an interior portion, each locking element 300 is provided with a locking element tab 301, which extends inwardly. A protrusion 302 is provided on the locking element tab 301.

The locking elements 300 on the first link 270, acting in combination with the locking slots 245, 255 and locking tabs 240, 250 of the second link 210 (FIG. 3), allow a user to lock the toy vehicle 10 in one of two configurations. In a first configuration, locking elements 300 may be moved inwardly such that two locking element tabs 301, spaced 180 degrees apart (only one of the locking element tabs 301 is visible in FIG. 4) simultaneously slide within locking slots 245, 255. In a second configuration the first link 270 is rotated 180 degrees relative to the second link 210 from the relative position of the links 210, 270 in the first configuration. In this second configuration, the locking element tabs 301 are positioned to slide within locking slots 245, 255. In either the first or second configuration, as the locking elements 300 are moved inwardly to the full extent of their inward travel, the locking element protrusions 302 move beyond and are engaged by first and second locking tabs 240, 250, respectively. Slot protrusions 260 and locking element tab protrusions 302 create an interference impediment to motion of the locking element 300 into the locking slots 245 and 255, requiring that a deliberate force be applied to the locking element 300 to slide it inwardly into the locking slots 245, 255. The slot protrusions 260 and locking element tab protrusions 302 thus help prevent the locking element 300 from moving into the locking slots 245, 255 during routine operation of the toy vehicle 10.

At the second end 272 of the first link 270, the first and second non-powered wheel 320, 325 are mounted to the body 275 for free rotation by an axle 340 and axle nuts 345. The non-powered wheels 320, 325 preferably are assemblies and comprise hubs 330 and tires 335. The non-powered wheel tires 335 are preferably pneumatic and preferably of a relatively high durometer value material, higher than the tires 150, 170 of the drive wheels 140, 160, to provide a coefficient of friction less than that of the tires 150, 170 and to thereby promote the ability of the tires 335 to skid across a supporting surface gripped by the drive wheel tires 150, 170 and thus enable the toy vehicle 10 to spin in place by driving drive wheels 140, 160 in opposite directions.

Figure 5:
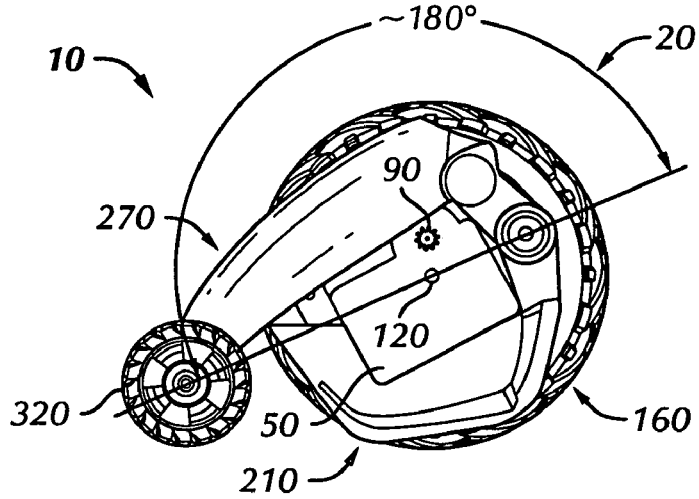
FIG. 5 is a side elevation view showing a first operating configuration of the toy vehicle of FIG. 1, with a drive wheel removed to improve clarity of the illustration.
Figure 6:
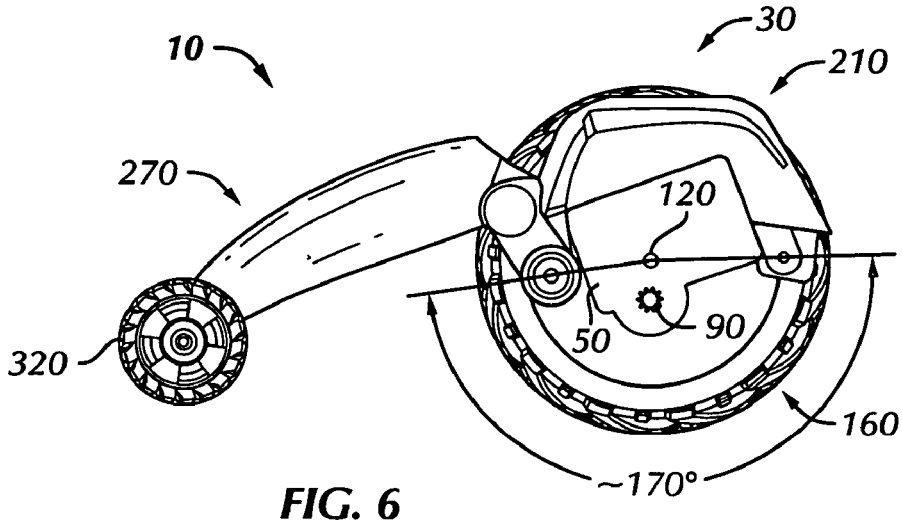
FIG. 6 is a side elevation view showing a second operating configuration of the toy vehicle of FIG. 5.
Figure 7:
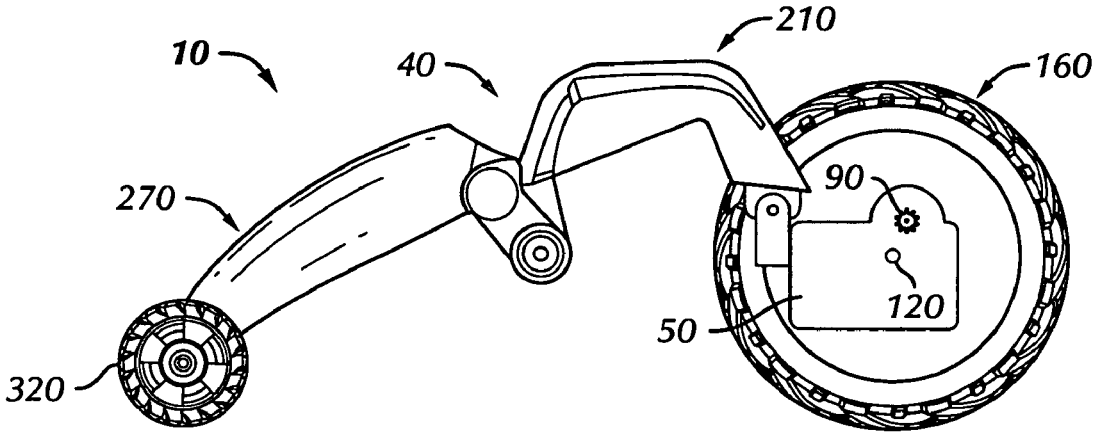
FIG. 7 is a side elevation view showing a third operating configuration of the toy vehicle of FIG. 5.

In operation, the vehicle 10 utilizes the counter torque developed on the chassis 50 in rotating the drive wheels in the same driving directions to either unwind and deploy the first and second links 270, 210 or wind up and retract the links. The vehicle 10 can assume three general configurations, illustrated in FIGS. 5–7 based upon different degrees of extension. FIG. 5 illustrates a first, fully-retracted operating configuration 20, wherein the first and second links are pivoted around and against the chassis 50. FIG. 6 illustrates a partially-extended configuration 30, wherein the second link 210 is pivoted around the chassis 50, but the first link 270 is extended away from the chassis 50. FIG. 7 illustrates a fully-extended configuration 40, wherein both the second link 210 and the first link 270 are extended away from the chassis 50. The user may lock the toy vehicle 10 in the fully retracted configuration 20. In all configurations, the vehicle 10 is supported by the drive wheels 140, 160 and the non-powered wheels 320, 325. Alternatively, the user may lock the second link 210 with respect to the first link 270. In this second locked configuration, the second link 210 can still pivot with respect to the chassis 50, and thus the toy vehicle can assume either the partially-extended configuration 30 or the fully extended configuration 40. The user may also to disengage the locking elements 300, allowing free rotation of the first and second links 270, 210 with respect to one another and with respect to the chassis 50.

With reference to FIG. 5, it is seen that the first link 270 "wraps" (i.e., is generally adjacent to, positioned against, and extends) partially around, preferably about half way or more around the chassis 50 over an arc centered at drive wheel axis 122, transversely spanning the wheel axis 122. More particularly, preferably the arc is approximately 180 degrees or more when the first link 270 is in the retracted configuration 20. The arc is measured between first and second lines, the first line extending from the center of wheel axle 120 to the pivot axis where first link 270 pivotally connects to a remainder of the toy vehicle 10 and the second line extending from the center of wheel axle 120 to an axis of rotation of wheel 320 mounted to the second end 272 of the first link 270. It is seen further in FIG. 6, that when the toy vehicle 10 is in either the fully retracted or partially extended configurations 20, 30, the second link 210 also "wraps" about half way or more around the chassis 50, more particularly over an arc of approximately (360−170=)190 degrees. Thus, in the fully-retracted configuration 20, the first link 270 and the second link 210 "wrap" around the chassis 50 more than 360 degrees so as to overlap one another opposite the ends which are pivotally coupled together.

In the absence of the toy vehicle 10 being locked into a configuration, this permits the torques mentioned above from driving the drive wheels can cause the first and second links 270, 210 to pivot with respect to one another and with respect to the chassis 50, winding and unwinding among the three configurations 20, 30 and 40 in a highly fast-paced and dynamic manner. Furthermore, when the toy vehicle 10 is positioned on one of its sides, it can spin about the exterior lateral surface of either driving wheel 140, 160 to effectively generate counter torque with only one wheel to wind and unwind the links 210, 270. When driven away from the non-powered wheels 325, 330 in the fully-retracted configuration, counter torque causes the links 210, 270 to unwind and extend out behind the chassis 50. Driving towards the wheels 325, 330 causes the chassis to wind up the links 210, 270.

As may be noted by extending a tangent line between the drive wheels 140, 160 and the non-powered wheels 320, 325 in FIGS. 5–7, only in the fully-retracted configuration 20 of FIG. 5 do all four wheels contact ground in either a "top side up" (that is, cover plate 70 oriented up) or "bottom side up" (cover plate 70 oriented down) position. In the partially-extended configuration 30 and the fully-extended configuration 40, the first and second link assemblies 270, 210 prevent the non-powered wheels 320, 325 from contacting the ground when the toy vehicle 10 is operated inverted or "bottom side up". The toy vehicle 10 can, however, continue to move along the ground when operated bottom side up in the partially-extended or fully-extended configurations 30, 40, with the toy vehicle 10 skidding along the top exterior portions of the first or second link 270, 210. If driven "away" from the non-powered wheels 320, 325 in this inverted orientation, the counter torque will cause the chassis 50 to wind up the links 210, 270. Conversely, if driven towards the non-powered wheels 320, 325 in this inverted orientation, the counter torque will cause any unextended portion of the links 210, 270 to extend out.

When locked in the fully-retracted position 20, the first and second links 270, 210 do not pivot with respect to one another. In this locked position, the toy vehicle 10 is capable of two-sided operation, as discussed above. The toy vehicle 10 is further capable of spinning motion about the exterior lateral surfaces of the drive wheels 140, 160. When the second link assembly 210 is pivoted away from and locked relative to the first link 270 in the extended configuration, the second link assembly 210 continues to rotate with respect to the chassis 50, allowing the toy vehicle 10 to alternate between the partially-extended and fully-extended configurations 30 and 40.

Figure 8:
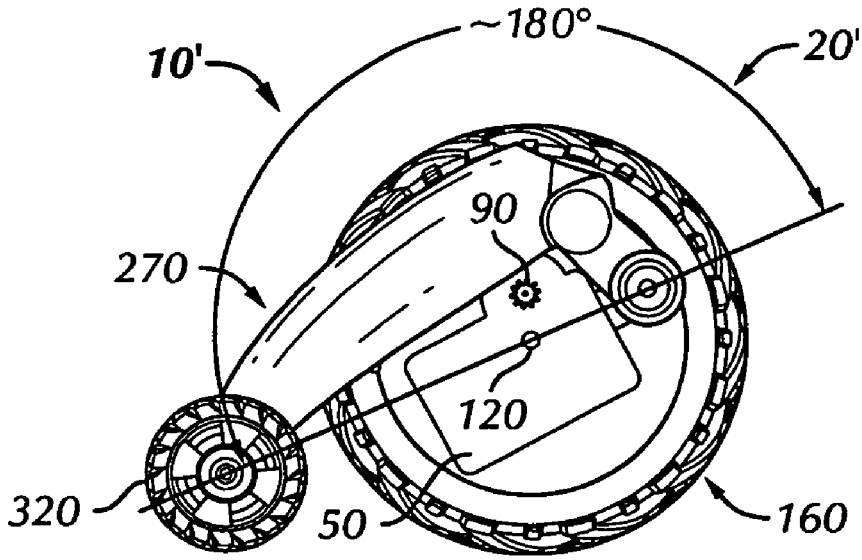
FIG. 8 is a side elevation view showing a toy vehicle in accordance with second preferred embodiment of the present invention, showing the toy vehicle in a first operating configuration, with a drive wheel removed to improve clarity of the illustration.
Figure 9:
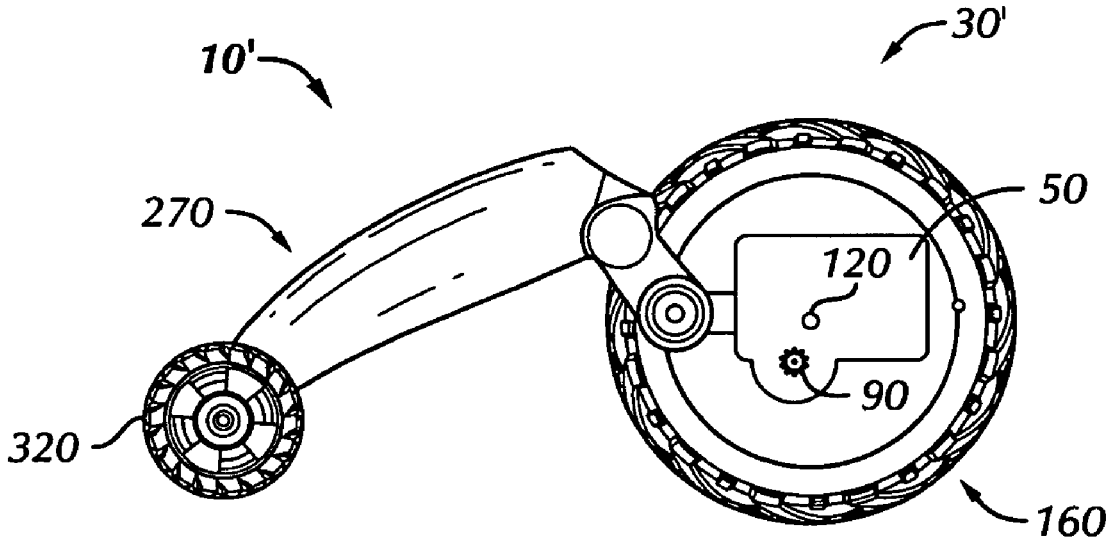
FIG. 9 is a side elevation view showing a second operating configuration of the toy vehicle of FIG. 8.

With reference to FIGS. 8 and 9, in a second preferred embodiment, a toy vehicle 10' includes only a first link 270 and omits the second link 210. In the second preferred embodiment, the non-driven wheels 320, 325 are attached to a second end 272 of the first link assembly 270. The structure and operation of the toy vehicle 10' is otherwise similar to the structure and operation of the toy vehicle 10. The second preferred embodiment 10' thus has two operative configurations, a fully retracted operating configuration 20' corresponding to the fully retracted operating configuration 20 of the toy vehicle 10 (see FIG. 5) and an extended configuration 30' corresponding to the partially-extended configuration 30 of the toy vehicle 10 (see FIG. 6).

Thus, the toy vehicles 10 and 10' comprise: a chassis 50; an electric power supply 65 supported by the chassis 50; at least a first drive motor 75 also supported by the chassis 50 and receiving power from the electric power supply 65; at least a first drive wheel 140 mounted to the chassis 50 to rotate about a wheel axis 122, the first drive wheel 140 being operably coupled with at least the first drive motor 75; at least a first link 270 having a first end 271 pivotally coupled with the chassis 50, and a second opposing end 272, the first link 270 having two operative positions: a first, fully-retracted operating configuration 20 (for toy vehicle 10) or 20' (for toy vehicle 10') wherein the first link 270 is positioned against the chassis 50, at least transversely spanning the wheel axis 122; and a second, extended operating configuration 30, 30' wherein the first link 270 is pivoted away and extended from the chassis 50 and the wheel axis 122; and at least a first non-powered wheel 320 rotatably attached to the second opposing end 272 of the first link 270, the toy vehicle 10, 10' being supported on the at least one driven wheel 140 and the at least one non-driven wheel 320 in both the first and second operating configurations 20, 20' and 30, 30' of the at least first link 270.

The toy vehicles 10 and 10' further comprise a wireless control receiver 185 supported by the chassis 50 and configured to receive wireless control signals to selectively control the at least first drive motor 75.

As illustrated in FIGS. 5 and 8, the at least first link 270 wraps at least partially around the chassis 50 in the first operating configurations 20 and 20'. Stated otherwise, the first link 270 wraps about half way around the chassis 50 in the first operating configuration 20, 20'. Stated still otherwise, the at least first link 270 wraps around the wheel axis about 180 degrees in the first operating configuration 20, 20'.

The chassis 50 has a generally rectangular lateral profile in a plane perpendicular to the wheel axis 122 and the at least first link 270 extends around at least two sides of the chassis rectangular profile. As illustrated in drawings, for example, FIGS. 5–9, in both the toy vehicles 10 and 10', at least first drive wheel 140 (which is identical to drive wheel 160 illustrated) is higher in side elevation than is the chassis 50.

As discussed above, torques acting on the chassis 50 resulting from driving the first drive wheel 140 can cause the first link 270 to pivot with respect to the chassis 50.

As is further discussed above, the first drive wheel 140 includes a hollow, air-filled tire 150. The first non-driven wheel 320 has a tire 335 which preferably has a higher durometer value than a durometer value of the tire 150 forming a part of the drive wheel 140. Preferably, when the wheels are in contact with a supporting surface, the first non-driven wheel 320 has a coefficient of friction less than a coefficient of friction of the first drive wheel 140. As illustrated in the drawings, for example FIG. 1, the first drive wheel 140 has a diameter larger than a diameter of the first non-driven wheel 320.

In the second embodiment, the first link 270 is pivotally attached directly to the chassis 50 of the toy vehicle 10'.

In the first embodiment, the toy vehicle 10 includes a second link 210 having a first end 211 and a second opposing end 212, the first end 211 being pivotally coupled with the chassis 50, the second opposing end 212 being pivotally attached directly to the first end of the first link 271. In both the first and the second operating configurations 10 and 20, the second link 210 is at least partially wrapped around the chassis 50. The toy vehicle 10 has a third operating configuration 40 wherein both the first link 270 and the second link 210 are pivoted away and extended from the chassis 50.

With the toy vehicle 10, the first and second links 270, 210 wrap essentially fully around the chassis 50 in the first operating configuration 10. The second end of the first link 272 at least partially overlaps first end 211 of the second link 210 in the first operating position 10. The second link 210 wraps about halfway around the chassis 50 in both the first and second operating configurations 10, 20. As described above, forces acting on the toy vehicle 10 resulting from driving the first drive wheel 140 can cause the first link 270 and the second link 210 to pivot with respect to the chassis 50.

As discussed above, the toy vehicle 10 further comprises a locking element 300 to lock the first link 270 into position relative to the second link 210.

In another aspect, the toy vehicle 10 comprises a chassis 50, an electric power supply 65 supported by the chassis 50; and at least a first drive motor 75 also supported by the chassis 50 and receiving power from the electric power supply 65. At least a first drive wheel 140 is rotatably mounted to the chassis 50, the first drive wheel 140 being operably coupled with at least the first drive motor 75. A plurality of pivotally connected links 270, 210 form a link chain having a first end 211 pivotally connected to the chassis 50 and having at least one non-powered wheel 320 at a second end 272 most distal from the chassis 50, the link chain having a first operating position 20 wrapped at least substantially around the chassis and a second operating position 40 unwrapped and extended away from the chassis 50. The toy vehicle 10 is supported on the at least one driven wheel 140 and the at least one non-powered wheel 320 in both the first and second operating positions 20, 40.

The toy vehicles 10 or 10' can be constructed of, for example, plastic or any other suitable material such as metal or composite materials using conventional fabrication techniques well known to those skilled in the art. From this disclosure, it would be obvious to one skilled in the art to vary the dimensions of the toy vehicles 10 or 10' shown, for example making components of the toy vehicle smaller or larger relative to the other components or to adjust the weight distribution among the components to obtain different performance characteristics.

Figure 10:
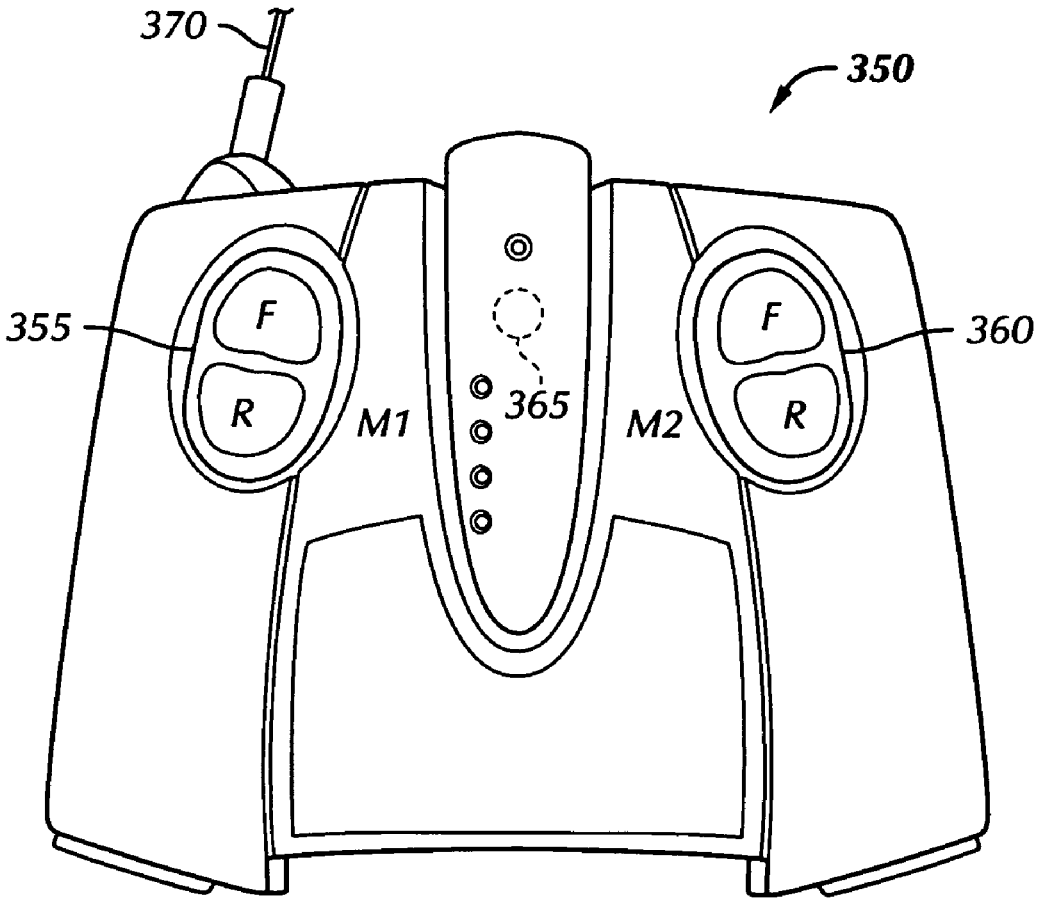
FIG. 10 is a front elevational view of a remote control transmitter adapted for use with either the first or the second embodiment of the present invention.

A preferred embodiment of a remote control transmitter 350 for use with the present invention is shown in FIG. 10. The remote controller 350 preferably comprises first and second toggle switches 355, 360 each of which separately and independently controls the forward and reverse motion of one of the one of the drive motors. Additionally, a third switch 365 is provided which serves to simultaneously drive both driven wheels 140, 160 in reverse. The third switch 365 acts as a "quick rewind" switch. Specifically, if the toy vehicle 10 is in the partially-extended or fully-extended configuration 30 or 40, or if the toy vehicle 10' is in the extended configuration 30', activation of the third switch 365 causes the toy vehicle 10 or 10' to move to the fully retracted configuration 20 or 20', respectively. The remote control transmitter 350 further preferably comprises an antenna 370. The artisan will recognize from this disclosure that the remote controller 350 can be formed of a variety materials, and may be modified to include additional control switches and/or buttons. The artisan will further recognize from this disclosure that a variety of other types of wireless controllers, for example ultrasonic wireless controllers or optical wireless controllers using infrared signals may be used to control the operation of the toy vehicle of the present invention.

Although the invention is describes herein in terms of the preferred, four-wheeled embodiments, the present invention could also comprise a vehicle having three wheels, or more than four wheels.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A toy vehicle comprising:

a chassis;

an electric power supply supported by the chassis;

at least a first drive motor also supported by the chassis and receiving power from the electric power supply;

at least a first drive wheel mounted to the chassis to rotate about a wheel axis, the first drive wheel being operably coupled with at least the first drive motor;

at least a first link having a first end pivotally coupled with the chassis, and a second opposing end, the first link having two operative positions: a first, fully-retracted operating configuration wherein the first link is positioned against the chassis, at least transversely spanning the wheel axis; and a second, extended operating configuration wherein the first link is pivoted away and extended from the chassis and the wheel axis; and at least a first non-driven wheel rotatably attached to the second opposing end of the first link, the toy vehicle being supported on the at least first driven wheel and the at least first non-driven wheel in both the first and second operating configurations of the at least first link.

2. The toy vehicle of claim 1, further comprising a wireless control receiver supported by the chassis and configured to receive wireless control signals to selectively control the at least first drive motor.

3. The toy vehicle of claim 1 wherein the at least first link wraps at least partially around the chassis in the first operating configuration.

4. The toy vehicle of claim 3 wherein the first link wraps about half way around the chassis in the first operating configuration.

5. The toy vehicle of claim 1 wherein the at least first link wraps around the wheel axis about 180 degrees in the first operating configuration.

6. The toy vehicle of claim 1 wherein the chassis has a generally rectangular lateral profile in a plane perpendicular to the wheel axis and the at least first link extends around at least two sides of the chassis rectangular profile.

7. The toy vehicle of claim 1 wherein the at least first drive wheel is higher in side elevation than is the chassis.

8. The toy vehicle of claim 1 wherein torque acting on the chassis resulting from driving the first drive wheel can cause the first link to pivot with respect to the chassis.

9. The toy vehicle of claim 1 wherein the first drive wheel includes a hollow, air-filled tire.

10. The toy vehicle of claim 1, wherein the first non-driven wheel includes a tire having a higher durometer value than a durometer value of a tire forming a part of the first drive wheel.

11. The toy vehicle of claim 1 wherein the first non-driven wheel has a coefficient of friction less than a coefficient of friction of the first drive wheel.

12. The toy vehicle of claim 1 wherein the first drive wheel has a diameter larger than a diameter of the first non-driven wheel.

13. The toy vehicle of claim 1 wherein the first link is pivotally attached directly to the chassis.

14. The toy vehicle of claim 1 further comprising:

a second link having a first end and a second opposing end, the first end being pivotally coupled with the chassis, the second opposing end being pivotally attacted directly to the first end of the first link;

wherein in both the first and the second operating configurations, the second link is at least partially wrapped around the chassis; and the toy vehicle having a third operating configuration wherein both the first link and the second link are pivoted away and extended from the chassis.

15. The toy vehicle of claim 14 wherein the first and second links wrap essentially fully around the chassis in the first operating configuration.

16. The toy vehicle of claim 14 wherein the second end of the first link at least partially overlaps the first end of the second link in the first operating configuration.

17. The toy vehicle of claim 14 wherein the second link wraps about half way or more around the chassis in the first and second operating configurations.

18. The toy vehicle of claim 14 wherein forces acting on the toy vehicle resulting from driving the first drive wheel can cause the first link and the second link to pivot with respect to the chassis.

19. The toy vehicle of claim 14 further comprising a locking element configured to lock the first link into position relative to the second link.

20. A toy vehicle comprising:

a chassis;

an electric power supply supported by the chassis;

at least a first drive motor also supported by the chassis and receiving power from the electric power supply;

at least a first drive wheel rotatably mounted to the chassis, the first drive wheel being operably coupled with at least the first drive motor;

a plurality of pivotally connected links forming a link chain having a first-end pivotally connected to the chassis and having at least one non-driven wheel at a second end most distal from the chassis, the link chain having a first operating position wrapped at least substantially around the chassis and a second operating position unwrapped and extended away from the chassis;

wherein the toy vehicle is supported on the at least first drive wheel and the at least one non-driven wheel in both the first and second operating position.

* * * * *